United States Patent [19]

Wentz

[11] Patent Number: 4,780,173

[45] Date of Patent: Oct. 25, 1988

[54] CARPET SEAM FINISHING TOOL

[76] Inventor: Kennith W. Wentz, Rte. 2, Box 458, Fayetteville, Ark. 72701

[21] Appl. No.: 160,755

[22] Filed: Feb. 26, 1988

[51] Int. Cl.[4] ..... B30B 15/08; B32B 35/00

[52] U.S. Cl. ..... 156/574; 156/304.4; 156/581

[58] Field of Search ..... 156/502, 505, 574, 579, 156/581, 304.4, 304.7, 545

[56] References Cited

U.S. PATENT DOCUMENTS

| | | | |
|---|---|---|---|
| 2,677,410 | 5/1954 | Reinhard | 156/574 |
| 4,584,040 | 4/1986 | Anderson | 156/579 |
| 4,617,083 | 10/1986 | Yrizarris | 156/579 |
| 4,699,686 | 10/1987 | Franke | 156/574 |

*Primary Examiner*—Michael Wityshyn
*Attorney, Agent, or Firm*—Robert R. Keegan

[57] ABSTRACT

There is disclosed a carpet seam finishing tool for smoothing and shaping the carpet at a seam joined with conventional hot glue carpet seaming tape comprising a pair of similar generally rectangular bodies hinged back-to-back having a width of at least about six inches and substantially greater than (four-inch wide) carpet seaming tape, the bottom smooth surface of each said body having longitudinal ridges on each lateral edge forming runners to guide the body along a carpet seam. The bottom surface of the body is preferably slightly convex across its width with air vent holes located to receive hot vapors or moisture from the hot carpet seam which is passes over. Each bottom surface further preferably includes an indentation on the end to allow the body to accommodate greater carpet height over tack strips near a wall. Preferably each body has a longitudinal V-shaped groove of diminishing width as it runs from the front to the center of said bottom surface to secure the carpet edges firmly together and avoid gaps between carpet edges along the seam. The hinged attachment of the tool permits it to first be used in folded position with a short longitudinal extent of contact area and to be unfolded to double the longitudinal contact area when used away from the walls of the room. The top is padded for comfort of the mechanic in riding the tool while operating the glue melting iron in front of it.

14 Claims, 6 Drawing Sheets

CARPET SEAM FINISHING TOOL

The present invention relates to apparatus to aid carpet mechanics in producing a neat, strong, virtually invisible seam using conventional hot glue seaming tape. The apparatus of the invention is particularly effective when used with synthetic-backed residential carpets, but is also adapted to be used on jute-backed carpet, axminister-backed carpet or other carpets (with the exception of glue-down carpets). The apparatus may be employed also on commercial "stretched-in" carpets.

Although means have been employed to apply pressure with weights or other means on hot glue tape seams in carpets and other fabrics, the apparatus of the present invention differs in that the slideable rigid body of the invention is especially shaped to assure a close joint between the two carpet edges, and also to impart an upwardly concave curvature to the cooling tape joint whereby the subsequent stretching of the carpet causes the joint to be pulled level with the carpet surface, or almost imperceptibly below the carpet surface, to produce an "invisible" seam. The apparatus of the invention is utilized with conventional hot glue seaming tape and a conventional seaming iron.

The overall procedure will be briefly described here (and more fully hereinafter) for a better understanding of the invention. Considering a room which is wider than the carpet being installed, a tape seam is made with the carpet on the floor after it has been cut and before it has been stretched and secured along the conventional tack strips adjacent the walls. The pad will normally be in placed under the carpet and the tape, glue side up, is placed under the straight junction line of the two carpet edges.

Conventional hot glue tape is typically provided with a heavy paper backing about four inches wide with a longitudinal web of fiberglass threads about three inches wide. A heavy ribbed layer of glue covers at least the central two inches of the web.

A seaming iron has a hot electrically heated plate about six inches long and wide enough to extend laterally over the glue layer on the seaming tape. The upwardly extending handle of the iron is supported by narrow posts requiring only slight separation of the carpet edges for the iron to pass along the top of the tape, but under the carpet. As the iron passes a given area of the tape and overlying carpet, the carpet seam is joined behind the iron. The finishing tool of the present invention is used as a slider or a sled bearing the carpet mechanic's weight, and following behind the seaming iron. A V-shaped groove in the bottom of the tool aids in pressing the two carpet edges snugly together, and the convex surface of the tool puts a concave "set" in the tape and carpet as the heat from the seaming iron dissipates.

The preferred embodiment of the tool is in two symmetrical parts hinged together so that the tool, when unfolded, is about two feet long. Runners along the bottom edges of the tool keep it aligned with the straight carpet seam as it is scooted along by the knee and leg of the carpet mechanic bearing most or all of his weight.

After the seam or seams have been finished and are cooled and set, the carpet is stretched and secured into place, during which process the concave set of the seaming tape and carpet seam tends to pull flat to provide a virtually level surface at the seam. Prior techniques for installing carpet joined with hot glue seaming tape without the tool of the present invention have almost invariably resulted in humps or raised portions along the seam, which prevented achieving an "invisible" seam.

It is known from observation and experience that the seam of a carpet joined with hot glue tape tends to jump or peak when the carpet is stretched, although the exact reason is not readily apparent. One explanation is that since the bottom surface of the two carpet pieces are joined the stretching forces cause the carpet edges to bend upwardly. Also, the carpet backing is more stretchable than the fiberglass reinforcement of the carpet seaming tape.

Whatever the reason for humping or peaking of the carpet when it is stretched, this tendency is counteracted by proper use of the finishing tool of the present invention. The finishing tool in effect pre-stresses the seam to a concave shape which causes it to be pulled straight in the stretching process. Any known prior devices for applying pressure to hot glued seams have failed to deal with the problems to which the present apparatus is directed, and the features of the present apparatus for dealing with carpet seam finishing problems have not been suggested by known prior devices.

In addition to providing the advantages and features described above, it is an object of the present invention to provide a carpet seam finishing tool in the form of a rigid body with a smooth generally convex surface particularly shaped to slide along a carpet seam bearing the weight of the carpet mechanic causing the carpet backing and tape to be securely joined and shaped in a slightly upward concave conformation, thereby avoiding humps or peaks along the carpet seam.

It is another object of the present invention to provide such a tool which is in two identical parts hinged together, and is provided with runners along the edges thereof as guides for sliding along the carpet seam.

It is still another object of the present invention to provide such a tool wherein the center of an end surface has a longitudinal groove of generally V-shape which tends to secure the edges of the carpet backing together along the seam.

It is yet another object of the present invention to provide such a tool wherein air vent holes are formed in portions of the surface to facilitate the escape of hot air or vapors from the heated carpet seam area and tape.

Other objects and advantages will be apparent from consideration of the following description in conjunction with the appended drawings in which.

Figure 1:
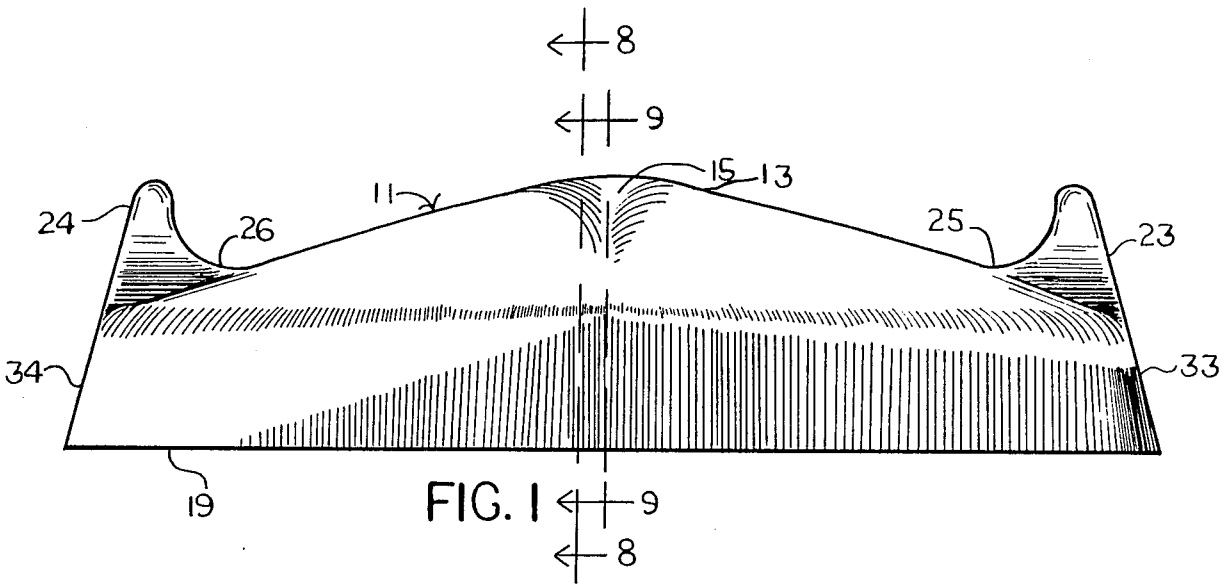
FIG. 1 is a front elevational view of the body of a tool according to the present invention.
Figure 2:
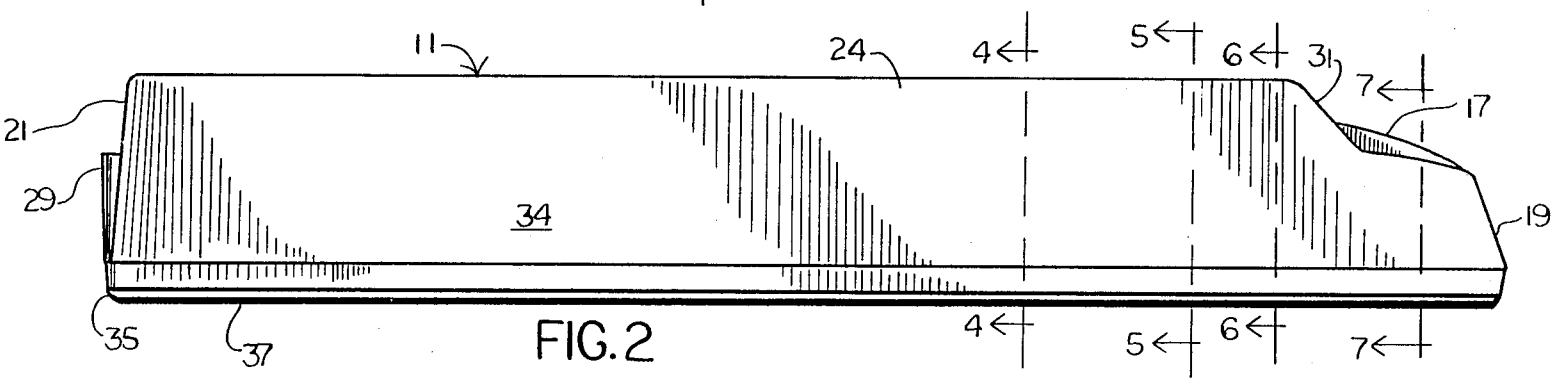
FIG. 2 is a side elevational view of one section of a tool according to the present invention.
Figure 8:
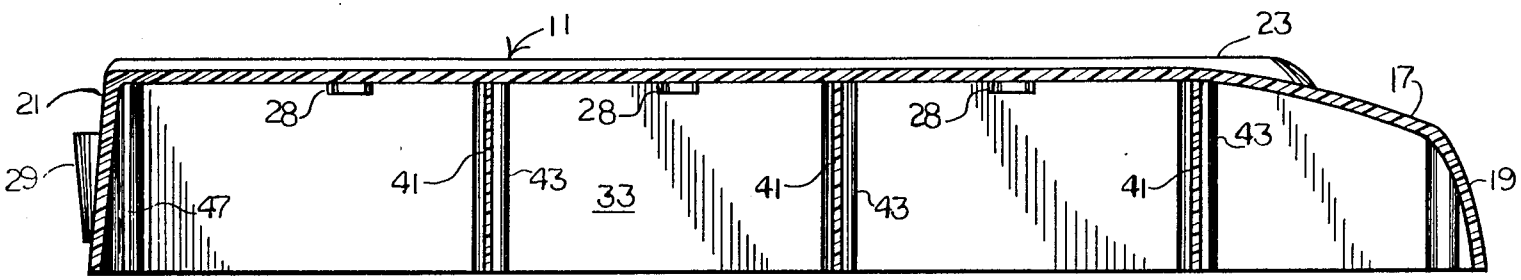
Figure 9:
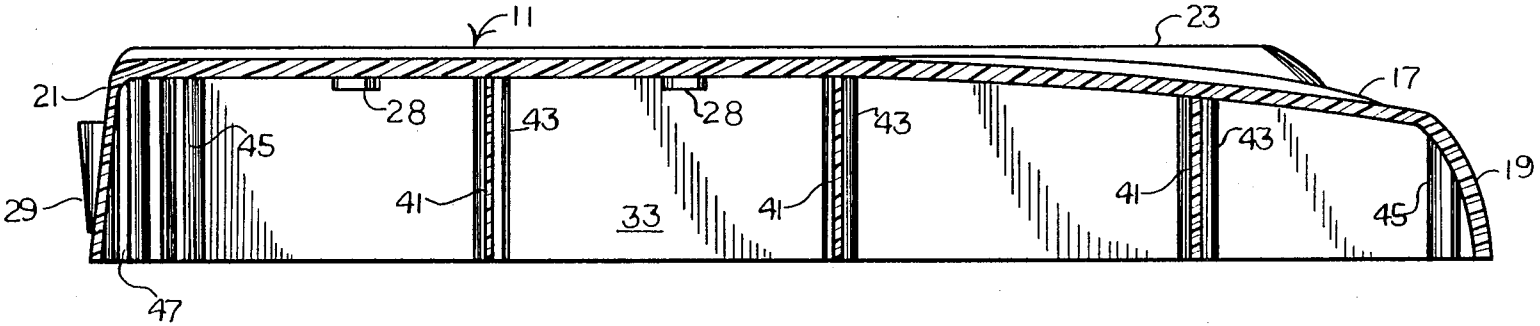
Figure 10:
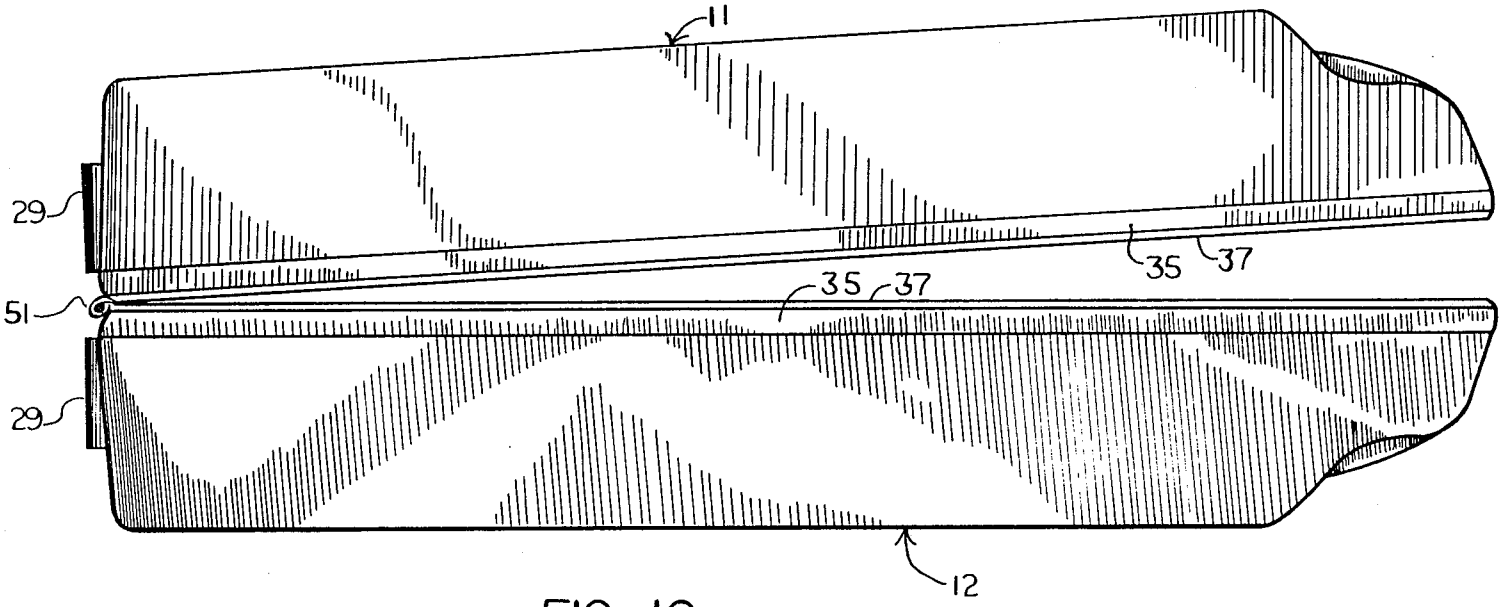
Figure 11:
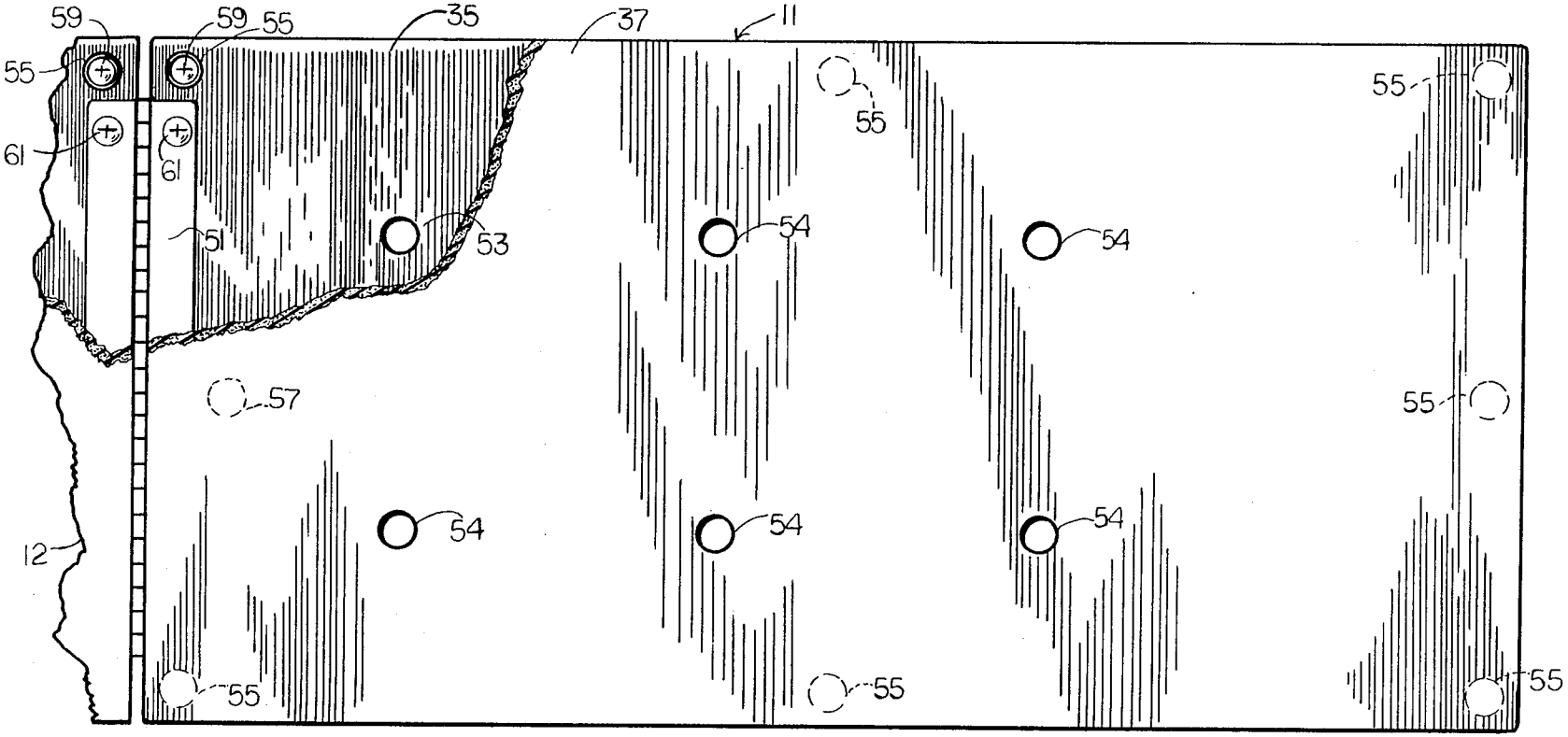

FIGS. 4, 5, 6, and 7 are sectional views of the body of the tool taken along the lines 4—4, 5—5, 6—6, and 7—7 in FIG. 2;

FIGS. 8 and 9 are sectional views of the body of the tool taken along lines 8—8 and 9—9 in FIG. 1;

FIG. 10 is a side elevational view of a preferred embodiment having two sections as shown in FIG. 2 hinged together; and FIG. 11 is a plan view partially broken away showing in detail the covers and pads also shown in FIGS. 2 and 10.

Figure 3:
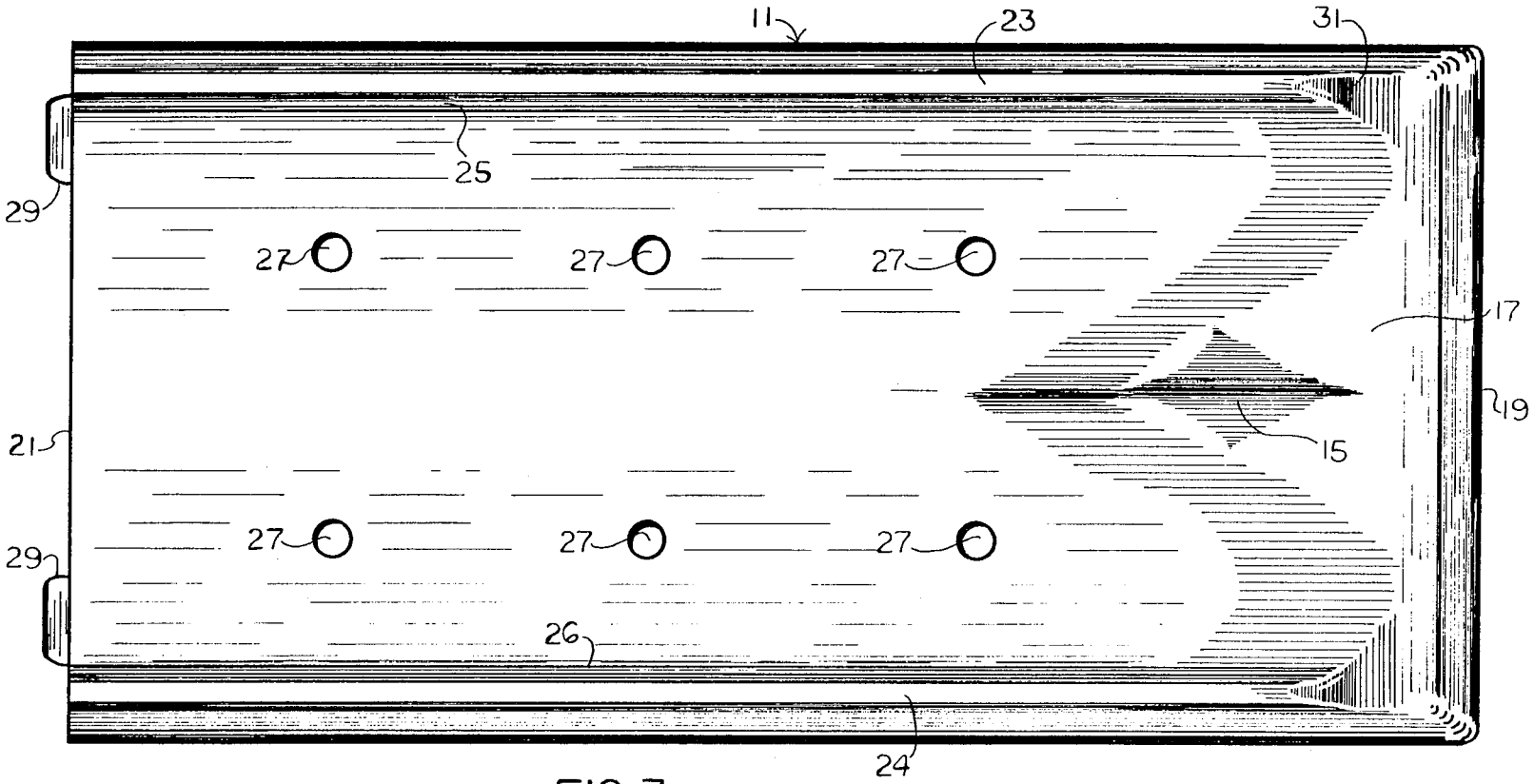
FIG. 3 is a top plan view of the apparatus of FIG. 2. In all views the apparatus is shown with the specially conformed surface upward for clarity although in normal use that surface will be downward on the carpet.
Figure 4:
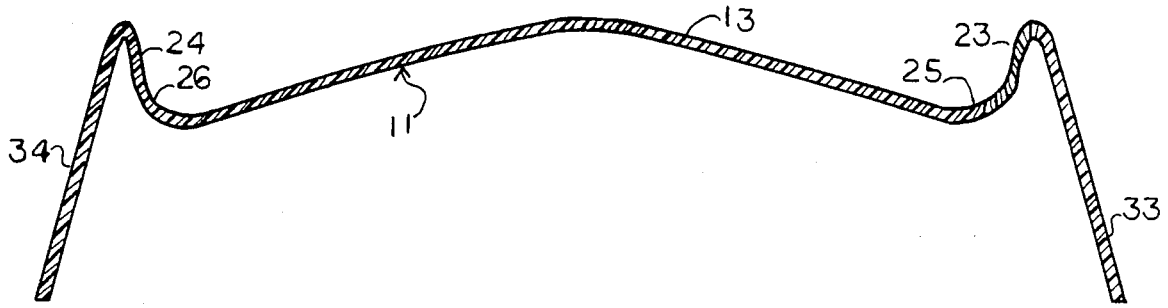

Referring to the drawings, and particularly FIGS. 1, 2, and 3, a carpet seam finishing tool 11 is shown which is preferably formed of molded plastic, but could be formed of metal, wood or other rigid material. In FIGS. 1 through 3 only one section of the tool is shown although it will be understood that a preferred embodiment consists of two such sections attached hingedly so that the working surface can be twice as long as that of the single section shown in FIG. 1, 2, or 3.

It should also be noted that for clarity of the drawings of the contoured surface, it is shown facing upwardly although in use it would be placed down against the carpet surface. Each tool section 11 may have a typical width of about seven inches, a maximum height of about two inches, and a length of about eleven inches.

As best seen in FIG. 1 the tool 11 has a generally convex curved surface 13. A groove 15 runs longitudinally of the tool for an inch or more near one end thereof. The groove is V-shaped and tends to secure the edges of the carpet backing together as the tool is moved along the carpet seam. Also, an important function of the groove 15 is to distribute excess glue to the center of the seam and, thus, to the carpet edges. The convex surface inclines at an angle of about 15° to valleys 25 and 26 on either side of the tool as seen in FIG. 1. Runners 23 and 24, which have a maximum height approximately equal to the center of the convex surface 13, serve to guide the tool in a straight line along the carpet seam and give stability to the tool so that the pressure on the seam from convex surface 13 is uniform. Sides 33 and 34 are not in contact with the carpet and may be straight and flat with a slight slope as shown, particularly in FIG. 1.

A front portion 17 of the surface is curved to reduce the drag as the tool is moved along the carpet, and front edge 19 is not in contact with the carpet so may be of any shape desired. Back side 21 of the tool 11 is not involved in shaping the seam and also may be a simple flat surface.

Holes 27 are provided as shown in FIG. 3 to allow the escape of hot air or vapors from under the tool as it rides over the still warm carpet seam. Projections 29 on the back 21 of the tool body act as stops in the embodiment where two sections are hingedly joined back-to-back (later described with reference to FIG. 10).

Front edges 31 of the runners 23 and 24 are terminated at least an inch back from front surface 19. The contoured ends allow the bottom of the tool 11 to be functional all the way to the end of the seam even though the seam end may be lying over a conventional tack strip at the wall of the room. Thus, a strong and uniform seam will be formed even near the edge of the carpet where it is secured to the tack strip.

Figure 5:
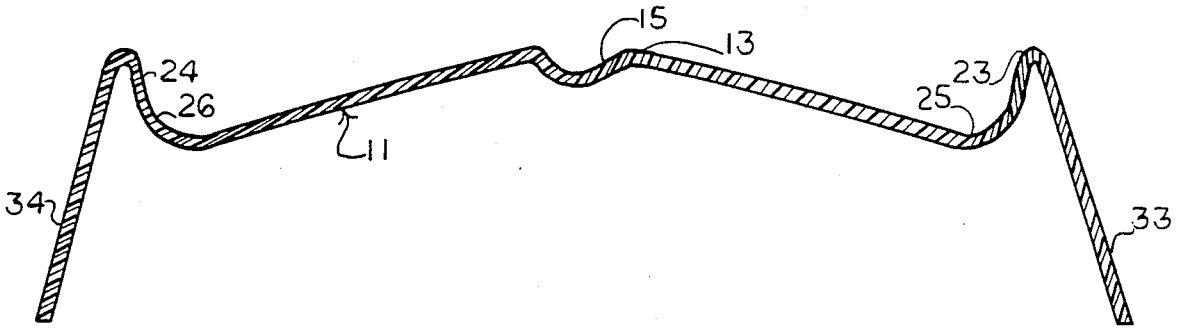
Figure 6:
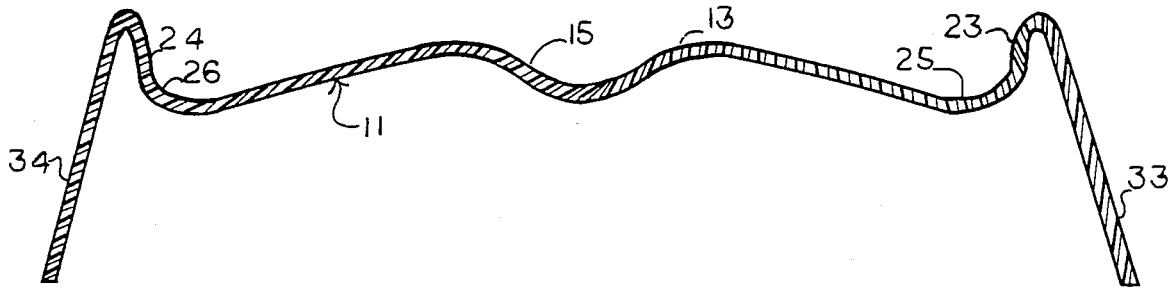
Figure 7:
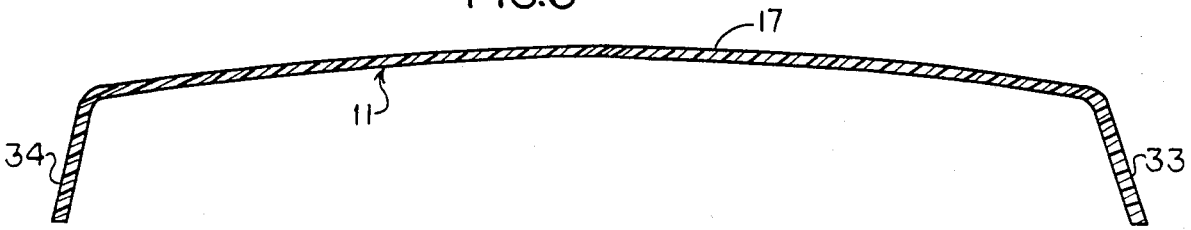

The shape of the body of the tool 11 is shown in more detail in FIGS. 4, 5, 6, and 7, wherein it will be seen that generally the rear three-quarters of the tool is of uniform lateral cross-section, and as seen in FIG. 5, the V-shaped groove 15 commences and deepens toward the front of the body as shown in FIG. 6. The rounded front edge 17, as shown in FIG. 7, is only slightly rounded in lateral cross-section and is forward of the termination of the V-shaped groove 15. The center of the convex surface (see FIG. 4) may not have a uniform radius of curvature but it is preferably between about two inches and eight inches. It may average about three inches.

As previously mentioned the shape and means of fabrication of the body of the tool is subject to modification, but FIGS. 8 and 9 show an exemplary preferred embodiment of the molded hollow plastic configuration. The plastic of which the body is formed is subject to wide variation, but it is preferably formed of Lexan (trademark for thermoplastic polycarbonate condensation product of bisphenol-A and phosgene), ABS, PVC, Nylon, Polystyrene, or other rigid, substantially unbreakable plastic by molding in one unitary piece. Alternatively the body could be molded in more than one piece and assembled by any suitable means.

Tool 11 as shown in FIG. 8 has a front edge 19 together with a sloping surface 17 and back side 21 as shown in previous Figures. Lateral webs 41 are provided running transversely of the body for structural reinforcement so that a weight of 250 pounds or more will safely be supported by the body. Approximately one-third of the way in from side 33 are reinforcing posts 43 of which three are shown in FIG. 8. Another three posts 43 are symmetrically located one-third of the way in from wall 34, but are not visible in FIG. 8.

Reinforcing rims 28 are provided for openings 27 to eliminate any problem of weakness or fractures in the vicinity of the holes 27. Studs 45, better seen in FIG. 9, are provided to accept screw fasteners or other fasteners utilized to hold cover 35 (seen in FIG. 2, 10 or 11) in position to close the opening in the body of tool 11.

Large studs 47 are molded against the rear 21 of the body and are positioned to accept the screw fasteners for a hinge 51 seen in FIG. 11.

In FIG. 10 a preferred embodiment has a tool section 12 identical to tool section 11 hinged thereto by hinge 51 as shown. The two sections 11 and 12 are slightly separated for illustration, but they would be folded flat together for storage or for certain special modes of utilization of the tool. In normal utilization of the tool the sections 11 and 12 would be completely unfolded with their respective surfaces 13 centered over the carpet seam.

As best seen in FIG. 11, covers 35 are provided for the tool sections, preferably formed of the same plastic and secured in place with screw fasteners 59 passing through holes 55 or 57 and engaging studs 45. Seven holes 55 and one hole 57 for fastening points are shown in FIG. 11, but a greater or lesser number of fasteners could be employed for the cover 35. Holes 54 are provided in cover 35 to allow the escape of hot air or vapors passing into the holes 27 in the surface 13.

Preferably a resilient plastic pad 37 of elastomeric material conforming to the shape of the cover 35 is fastened by adhesive or other suitable means onto cover 35 and provides a suitable riding surface to accommodate the knee and leg of the carpet mechanic. Hinge 51 is of conventional form and is secured by conventional screw fastening means 61, which engage large studs 47 in tapped holes provided for that purpose.

Although the preferred methods of use of the tool have been generally described, its advantages will be better understood by reference to a more detailed descripton of the method of use. The seam to be formed with seaming tape is normally made after the carpet has been positioned in the room and the two edges to be seamed have been carefully placed with two straight edges of the carpet backing together. The pad is in place under the carpet and the seaming tape, with glue side up, is carefully aligned under the carpet parallel to the carpet edges. Starting at one wall, the two sections of the tool are closed, or folded together. After the seaming iron has been applied to the seaming tape glue for the proper time to heat the tape and glue the iron is moved approximately twelve inches from the wall, and the tool (in folded position) is placed on the carpet seam with the contoured end surface 17 against the wall.

After the seaming iron is moved for the second time away from the wall the tool is unfolded to full length and the carpet mechanic may then place his full weight on the tool by kneeling on the front section facing the center of the room. Each time the seaming iron is moved to progress along the seam, the tool is slid to a position immediately behind the seaming iron with the weight of the carpet mechanic serving to keep pressure on the carpet surface.

It should be noted that the forward edge of the body of the tool is shaped to accommodate the tacking strips normally found at the edge of the carpet so that a secure and neat seam is formed completely across the carpet.

About 15 minutes should be allowed before disturbing the seam to allow the glue to set and the carpet and tape to cool. A check should be made to see that the seaming tape has not adhered to the pad at any place along the seam.

After allowing for setting and cooling, the carpet is ready to stretch in conventional fashion, but contrary to usual practice the carpet seam will have a slight concavity rather than a ridge or hump normally left by the seaming iron along. Stretching of the carpet by conventional means will bring the seamed area level. Better results will be achieved if care is taken not to overstretch the carpet, which could result in the seam area being slightly raised. Normally one inch of stretch per ten feet of carpet will produce optimum results.

The procedure is slightly different in making a T-seam, a door seam, or a cross-buck seam in that "riding" the tool is not necessary to increase the pressure applied to the carpet seam. In such cases a pressure of ten to twelve pounds on the opened finishing tool will produce the best results. As usual some grooming of the seam may be desired after installation is completed.

It will be appreciated that the process of using the tool as well as the specific information of the tool structure is subject to wide variation. For example, the tool may be provided with more padding, less padding, or no padding for the carpet mechanic's knee and leg. Also, the flat surface of the tool which is uppermost in use may be modified to have a different shape. In particular the tool may be made longer or shorter, and may have only one section, or more than two sections. The openings for the escape of hot air and vapors may be omitted, or they may be made more numerous and they may be smaller or larger.

Other variations and modifications to the invention beyond those described or suggested will be apparent to those of ordinary skill in the art, and the scope of the invention is not to be considered limited to the particular embodiments shown, but is to be determined with reference to the appended claims.

What is claimed is:

1. A carpet seam finishing tool comprising a rigid body having a smooth bottom surface, said surface having a width substantially greater than the width of a conventional hot glue carpet seaming tape, said surface having parallel lateral edges with ridges forming runners on said edges for guiding said tool along the carpet seam, the central portion of said surface being slightly convex in lateral section with a radius of curvature of about two inches to about eight inches.

2. Apparatus as recited in claim 1 wherein said surface is symmetrical relative to its longitudinal axis.

3. Apparatus as recited in claim 1 wherein said surface has longitudinal concave channels spaced apart by slightly more than the width of said tape and being only slightly spaced from the lateral edges of said surface and said runners.

4. Apparatus as recited in claim 1 wherein air vent holes are formed in said central portion of said surface.

5. Apparatus as recited in claim 1 wherein the center of the front end of said surface has a longitudinal groove of diminishing depth as it approaches the center of said surface.

6. Apparatus as recited in claim 1 wherein said body has an extension on the front end thereof with a downward facing surface displaced upwardly from said bottom surface to allow for greater carpet height over carpet edge tack strips.

7. Apparatus as recited in claim 1 further including a second rigid body substantially the same as the above-said rigid body and hingedly attached back-to-back therewith.

8. A carpet seam finishing tool comprising a rigid, at least partially hollow, body having a smooth bottom surface for sliding over a hot adhesive sealed carpet seam, said surface having a width greater than the width of a conventional hot glue carpet seaming tape, said surface having longitudinal concave channels spaced apart by slightly more than the width of said tape and being only slightly spaced from the lateral edges of said surface thereby forming longitudinal runners on said edges for guiding said tool along the carpet seam, the central portion of said surface being slightly convex in lateral section with a radius of curvature of from about two inches to about eight inches, the front end of said surface having a longitudinal groove of diminishing width as it approaches the center of said surface.

9. Apparatus as recited in claim 8 wherein said surface is symmetrical relative to its longitudinal axis.

10. Apparatus as recited in claim 8 wherein air vent holes are formed in said central portion of said surface.

11. Apparatus as recited in claim 8 wherein said longitudinal groove is V-shaped.

12. Apparatus as recited in claim 8 further including a second rigid body substantially the same as the above-said rigid body and hingedly attached back-to-back therewith.

13. A carpet seam finishing tool comprising a rigid, at least partially hollow, body having a substantially rectangular smooth bottom surface for sliding over a hot adhesive sealed carpet seam, said surface being symmetrical relative to its longitudinal axis and having a width less than its length but substantially greater than the width of a conventional hot glue carpet seaming tape, said surface having longitudinal concave channels spaced apart by slightly more than the width of said tape and being only slightly spaced from the lateral edges of said surface thereby forming longitudinal runners on said edges for guiding said tool along a carpet seam, the central portion of said surface being slightly convex in lateral section with a radius of curvature of from about two inches to about eight inches, and having air vent holes formed therein, the center of the front end of said surface having a longitudinal V-shaped groove of diminishing depth as it approaches the center of said surface to smoothly merge into said surface.

said body having an extension on the front end thereof with a downward facing surface displaced upwardly from said bottom surface to allow for greater carpet height over carpet edge tack strips, and a second rigid body substantially the same as the above-said rigid body and hingedly attached back-to-back therewith.

14. Apparatus as recited in claim 13 wherein the radius of curvature of said central portion of said surface is about three inches.

* * * * *